US007274550B2

(12) United States Patent
Flores-Jauregui

(10) Patent No.: US 7,274,550 B2
(45) Date of Patent: Sep. 25, 2007

(54) SINGLE PHASE CONTROL AND PROTECTION SYSTEM OF HIGH VOLTAGE WITH DRY INSULATION

(76) Inventor: Jose Manuel Flores-Jauregui, Ives Limantour No. 56, Circuito Economistas, Ct. Satelite, Estado (MX) 53100

( * ) Notice: Subject to any disclaimer, the term of this patent is extended or adjusted under 35 U.S.C. 154(b) by 749 days.

(21) Appl. No.: 10/374,844

(22) Filed: Feb. 26, 2003

(65) Prior Publication Data

US 2003/0202308 A1 Oct. 30, 2003

(30) Foreign Application Priority Data

Apr. 30, 2002 (MX) ..... PA/a/2002/004309

(51) Int. Cl.
*H01H 73/00* (2006.01)

(52) U.S. Cl. ..... 361/115

(58) Field of Classification Search ..... 361/115
See application file for complete search history.

(56) References Cited

U.S. PATENT DOCUMENTS 5,585,611 A * 12/1996 Harvey et al. ..... 218/155
6,242,708 B1 * 6/2001 Marchand et al. ..... 218/153
6,295,190 B1 * 9/2001 Rinaldi et al. ..... 361/115
6,373,015 B1 * 4/2002 Marchand et al. ..... 218/139
6,687,110 B2 * 2/2004 Murray ..... 361/131
6,845,301 B2 * 1/2005 Hamamatsu et al. ..... 700/292
6,888,086 B2 * 5/2005 Daharsh et al. ..... 218/155
6,897,396 B2 * 5/2005 Ito et al. ..... 218/120
7,133,271 B2 * 11/2006 Jonas et al. ..... 361/115

* cited by examiner

*Primary Examiner*—Ronald W. Leja
(74) *Attorney, Agent, or Firm*—Welsh & Katz, Ltd.

(57) ABSTRACT

A protection system and single-phase control of high voltage with close loop dry insulation is provided. A detector detects the voltage through the influence of the electrical field in conductors, insulators and breakers, mainly, turning the field into an electronic signal. This signal is processed by means of a control and protection unit and responds through a trip mechanism so that if needed the contacts get opened or closed to allow or stop the flow of current through the system. A method to increase the life expectation of the contacts in the vacuum breaker chambers is also provided.

21 Claims, 5 Drawing Sheets

SINGLE PHASE CONTROL AND PROTECTION SYSTEM OF HIGH VOLTAGE WITH DRY INSULATION

FIELD AND BACKGROUND OF THE INVENTION

The present invention relates to a protection system of high voltage and more particularly to a protection system and single-phase control of high voltage with close loop dry insulation. A detector detects the voltage through the influence of an electric field in conductors, insulators and mainly breakers, turning the field into an electronic signal.

Auxiliary power transformers or their equivalent, are currently available, and in some cases (e.g. insulators for the measurement and detection of voltage presence on the line) are used as an information source for real-time control systems. These transformers require an additional external installation between the line and the protection or control device, which require additional material and new connection points, which are necessarily connectors exposed to weather, and are potential failures from a variety of causes, such as hot spots. The auxiliary power transformer itself is a potential catastrophic failure factor if it violently ejects the resin that surrounds it and bercomes directly exposed to ultraviolet rays; such an occurrence considerably reduces its useful life, demanding, consequently an increase in its maintenance and resulting in increased operational costs and service interruptions.

Voltage and Current detectors and auxiliary power transformers are generally external and are mounted on cross arms and/or armed structures attached to posts. Voltage and current detectors are normally built separately to be installed later; there are other detectors wherein voltage and current elements can be found in a single insulator, and are mounted on cross arms outdoors (outside a tank).

In the present case, the auxiliary power transformer and the current and voltage detectors are integrated inside the protection equipment, forming a single low cost unit, and easily installed.

In some technical cases, especially in the case of devices outside the tank, the devices may not be tested at the same time along with the mechanism in accordance with the specific standard of the protection device. In such a test the totality of devices as a whole are tested under simulated conditions, therefore on final installations without such a test there can be additional unexpected problems, bigger installation costs, lack of precision and the systems demand extra time to achieve results and the equipment reliability diminishes as time goes by.

Systems in the state of the art modify voltage and current work scale using dip switches which modify the settings of the electronic control for new nominal current requirements or different protection coordination which may be desired in order to interrupt the current flow (user side). These systems cannot guarantee that the chosen scale be real, but they would have to take the device to a test laboratory and test it and certify its function.

In view of the above, in order to change the control type and protection system it is also necessary to stop the load flow (user side) to change the necessary elements.

SUMMARY OF THE INVENTION

The system of the present invention overcomes the above-mentioned difficulties being a protection system for high voltage applications with dry insulation while being protected from the surrounding. The system is insulated from the surrounding by means of a container or tank, preferably metallic, although other materials such as exotic plastics may be used.

The system mainly comprises a voltage detector, current detector, signal conditioner unit, trip device, vacuum breaker device, and control unit (line failure protection), although a control unit designed specifically for this system or a conventional design may be used.

One of the main characteristics of this system is that it is self-supported. It operates exclusively with the current provided by the line to which it is connected and that it transforms for its own operation. Another important characteristic is the fact that the control type and protection system as well as the work scale voltage and current can be modified on line. These changes are more assuredly operational because all the elements are calibrated and certified from the test floor as a unit (protection system), as opposed to the existing ones, which are tested as insulated systems and are attached to the main device afterwards.

As stated, the system of the present invention is self-supported, which means that the system operates only if connected to protected input and outlet wires. All of its functions will be described further on.

With the system of the present invention, the presence or absence of voltage as well as its value, can be detected almost instantly because the feeders are integrated inside the tank on the source side, as well as, on the charge side. The system interprets the detected signal and responds in an instantaneous manner in accordance with pre-established parameters in the control and protection unit.

DETAILED DESCRIPTION OF THE INVENTION

Figure 1:
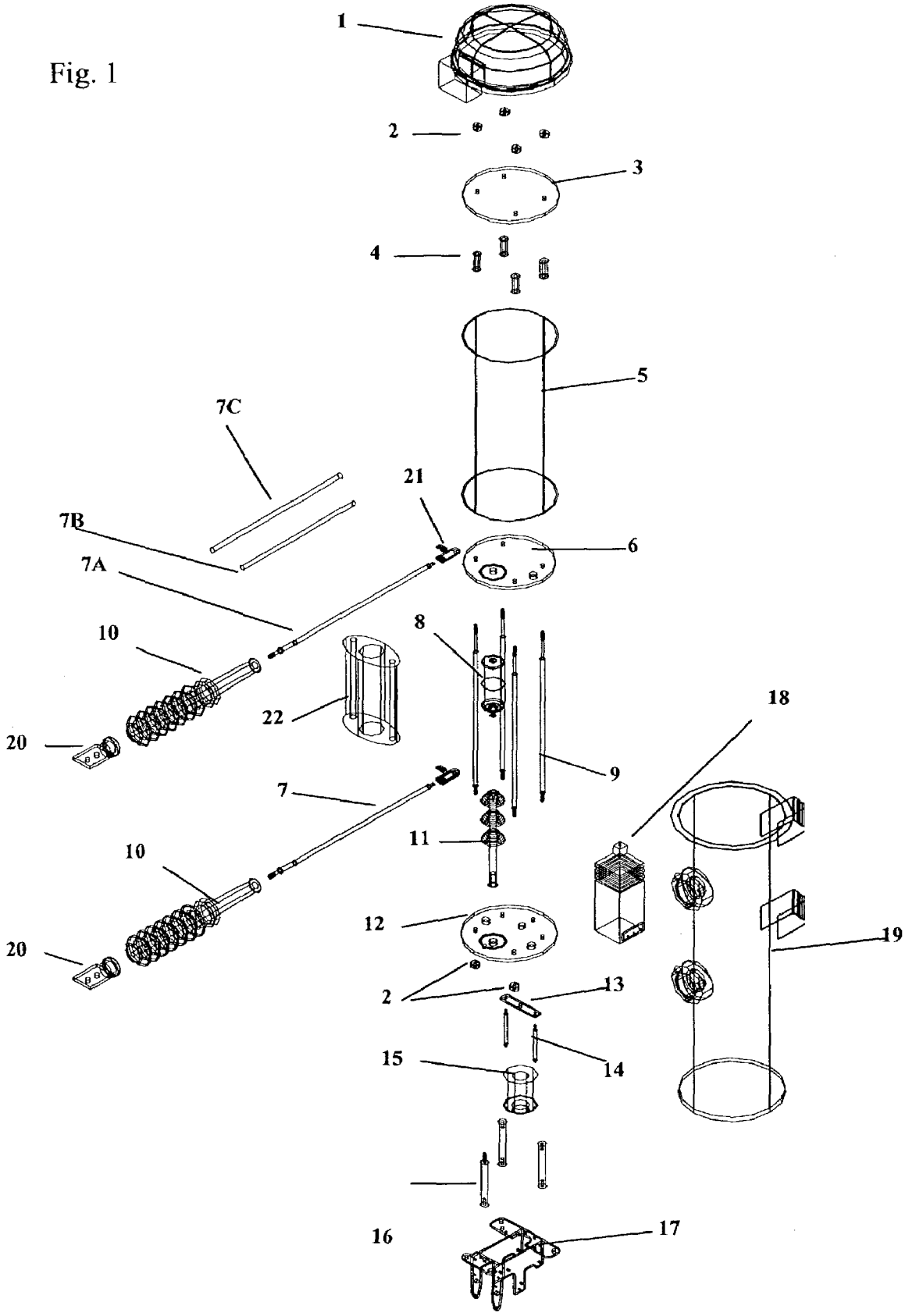
FIG. 1 is a schematic exploded view of the single-phase protection system in a preferred embodiment.

The system of the present invention has the following main characteristics:

a) It is self-supported. The system takes from the line all the electrical current it requires for its operation. It is herein explained how this is achieved.

b) It covers a range from 5 to 1200 A and from 2400 V to 34.5 kV.

c) The control unit may be replaced on line, so that voltage, ampere current and control type, among other parameters may be changed by changing the protection and control unit.

d) It provides reliable operation parameters. Because this is a control and protection device that has already been tested and certified in a laboratory as a unit, its attachment to the whole system will provide it reliability because the limits are already set in the control and protection unit. Each of the control elements may be calibrated one time or multiple times depending upon the specific function the system will perform.

e) This system has dry insulation. The vacuum breaker chamber is insulated by dry insulation, something that cannot be found in devices of this kind found in the state of the art, which are generally insulated by using dielectric oil or a solid dielectric insulation.

f) The breaker chamber (or vacuum bottle) is interchangeable. This is a very important characteristic, since it is not necessary to change the whole system if the chamber fails; it is enough to change the chamber from the system and continue operating without significantly interrupting the operation of the line in the event of a malfunction of the breaker chamber. In the dry insulation system this is not possible.

DETAILED DESCRIPTION OF THE DRAWING

Figure 2:
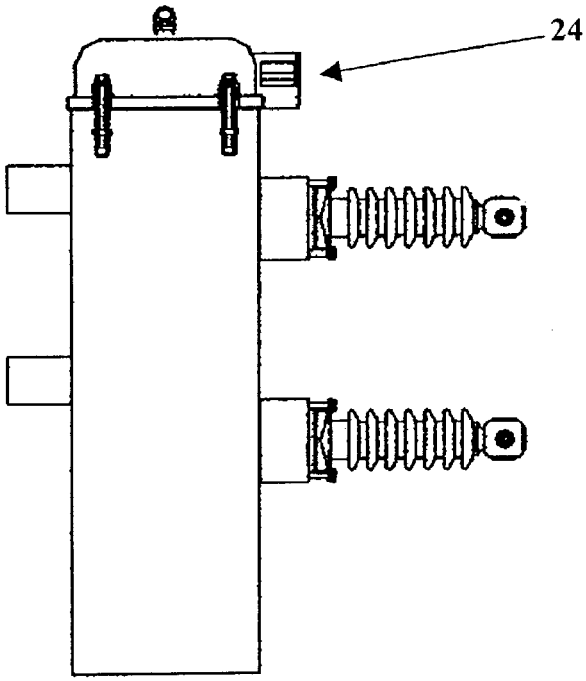
FIG. 2 is a lateral view of the system shown in FIG. 1.
Figure 2A:
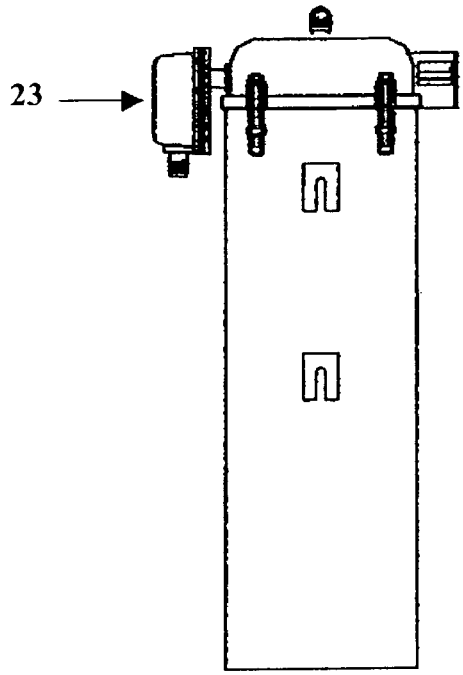
FIGS. 2A and 2B are both lateral and top views respectively of the same system.
Figure 2B:
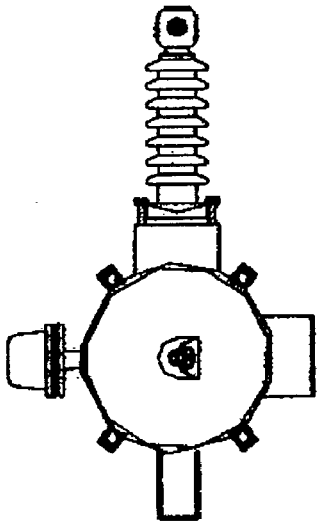

In reference to FIG. 1, the Single Phase Control and Protection System of High Voltage with Dry Insulation schematically represented in FIG. 2 comprises a tank 19, with an internal part wherein the breaker vacuum chamber 8 is set; the chamber 8 is wrapped in a preferred mode by a dry insulation 22, which comprises primarily epoxy insulation resins and varnishes.

Figure 1A:
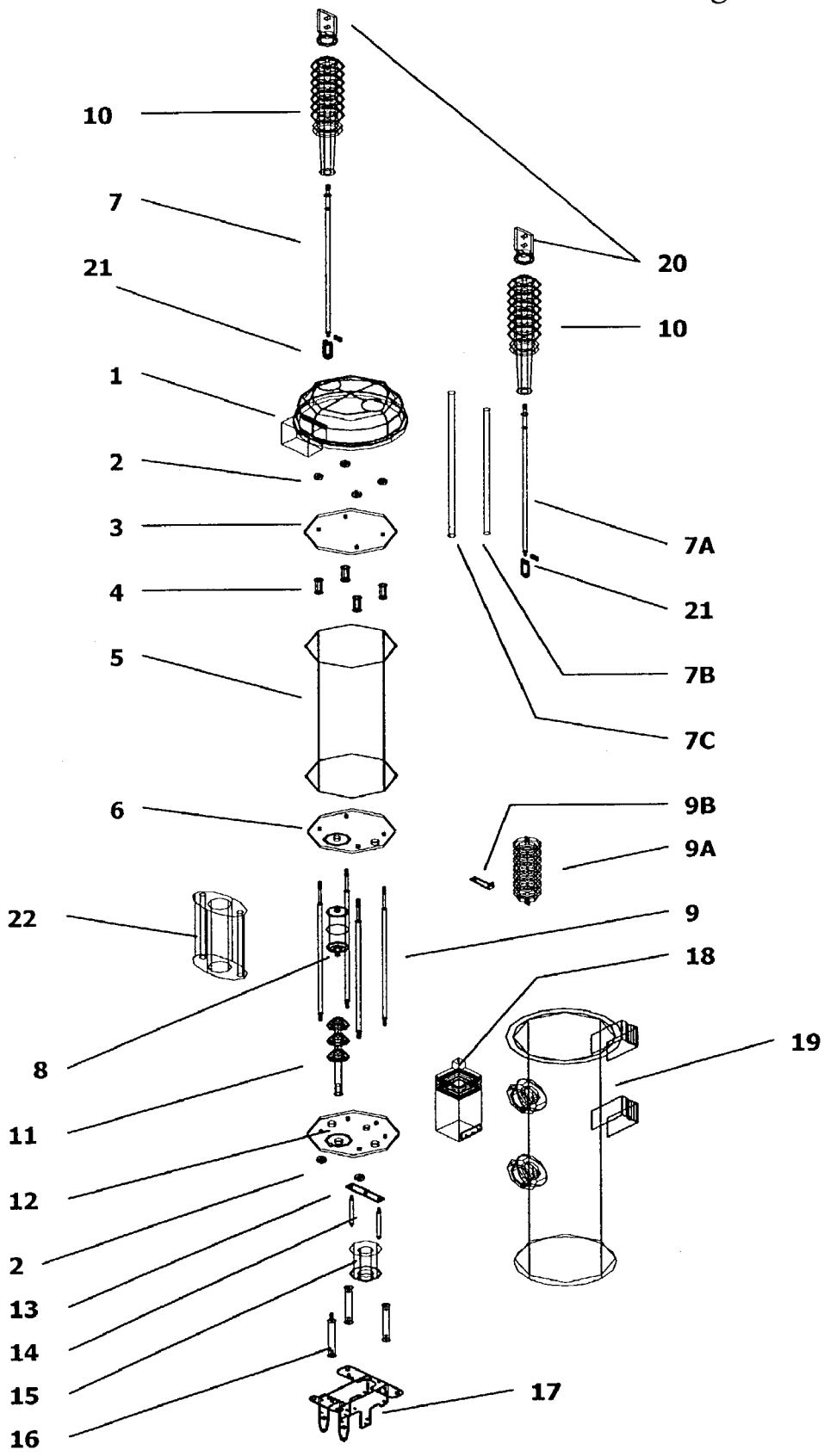
FIG. 1A is a schematic exploded view of another embodiment.

To maintain this chamber 8 in its position, as can be see in FIG. 1 or 1A, posts 9 and the respective nuts 2 are used. In the higher and lower parts of these posts a top support insulation plate 6 is fixed to the chamber 8, and a bottom support insulation plate 12 is fixed to the chamber 8. FIG. 1 depicts the breaker vacuum chamber 8, which is not in the center of the tank 19, but offset from its longitudinal center.

A capacitive protective magnetic shield is used for the conductor rods 7 shown in FIGS. 1 and 1A. This magnetic shield includes a layer coat of impregnated insulation 7A, with a metallic, non-magnetic tube 7B and a thermocontractile high voltage insulation 7C. This impregnated insulation 7A may consist of an impregnated insulation and/or a tube of insulating material; the outside insulation 7C may also consist of insulation epoxy resins or varnish. The array of elements 7A, 7B, and 7C, is the same as for element 9A, that is to say, it is first applied 7A, afterwards 7B and finally 7C. A dry insulation coating could also be used once the magnetic coating is applied.

The insulation may be a resin such a poly vinyl chloride resin, poured, sprayed or painted in a place so as to cover at least the low voltage electrical conductors, connectors and other electric parts. When the resin is in place covering such components it is heated by hot air from 0° to 200° C., which cures and shrinks the resin to a formfitting insulative cover. Alternatively, an extruded PVC wrapping such as a tube might be similarly shrink wrapped about the low voltage components.

In the embodiment illustrated in FIG. 1A, a coil has been included.

Both plates 6 and 12 have four equidistant and corresponding support holes to allow the entrance of support rods 9, and a support borehole as well on both plates 6 and 12; the borehole is designed in such a way that connecting wires 21 can go through it and in the case of FIG. 1, an end of the switchboard is threaded 11 for its attachment by means of nuts. Conductor rods 7, are generally horizontally placed in a preferred mode, although as can be seen in FIG. 1A they can also be placed vertically, fastened on one of its ends to their respective connecting top and bottom terminals 21 and on the other end to the nozzles 10, which in turn and on the remaining end are fastened to the outside connectors 20. Finally these external connectors 20 are fixed to the distribution line.

On the bottom end of the vacuum chamber 8 and connected to the lower connecting terminal 21 a switchboard 11 can be found; the connecting lower terminal 21 is placed between the vacuum chamber 8 and switchboard 11, which is fixed to the bottom support plate 12.

The bottom-threaded end of the switchboard 11 can also be used to fasten by means of a spiral screw the supports 13 of solenoid 15. The fastening to the support can be made by conventional screws. At the same time, the bottom threaded ends of the support posts 9 can be used as fastening elements for the support posts to affix the open/close mechanism 17. The separators are made of insulating material.

The PVC insulation support cylinder 5, provides additional support for a section of the chamber or vacuum breaker as well as an insulation barrier between the metallic tank 19 and the rest of the elements connected to the high voltage. After analyzing a variety of materials for this element, it was surprisingly found that PVC has excellent insulation properties at this voltage and ampere values. Up to this date, PVC had never been used as an insulation barrier in this kind of system.

The power source transformer 18 or source is placed over the insulation plate 12 by conventional means such as screws or rivets (not shown). This power source is connected to a phase of the input line and provides 120V for the closing solenoid and the charge system; said power source is in line with the system and is mounted externally. An important characteristic is that when the restorer is tested in short circuit, the source also has a short circuit test. External equipment belonging to the state of the art are not subject to this type of test and therefore are additional failure factors.

The switchboard 11 is fastened to the vacuum chamber 8 by means of a metallic screw positioned into the chamber; terminal 21 is connected in this screwed joint, as well as the high voltage terminal of the power transformer 18. The switchboard 11 transmits the close/trip movement from the mechanism 17 to the vacuum chamber 8.

The electronic microprocessor or analog control, gathers the information of the system state as well as current and voltage values of the line wherein it is installed. The control contains all the necessary circuits for the processing of the control system.

The lever compartment 24 houses the external levers for manual operation in site, the trip counter and the banner that marks the state of the vacuum chamber.

Depending upon where the conductor rods 7 are situated, element 9A may or may not be present.

Figure 3:
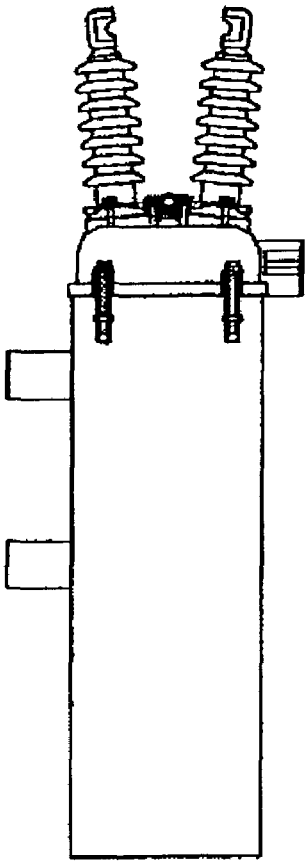
FIG. 3 is a view of an embodiment of the single-phase protection system of FIG. 1A, wherein the input and outlet wires of the line are located in the higher side.
Figure 3A:
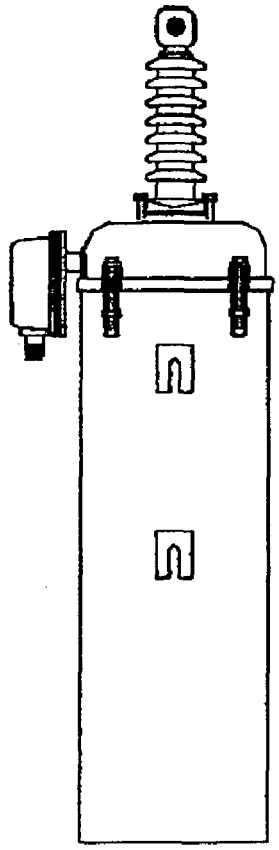
FIGS. 3A and 3B are an overview and lateral view of the system in FIG. 3 respectively.
Figure 3B:
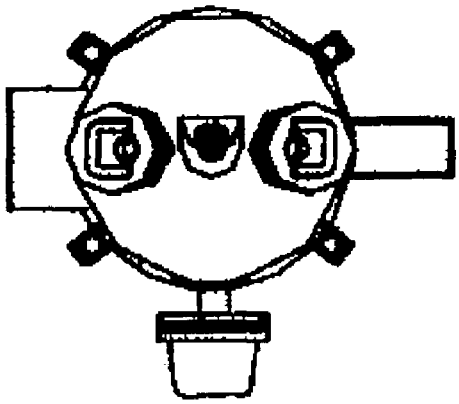

FIGS. 3, 3A and 3B are different views from the system shown in FIG. 1A. In this case the lines are installed horizontally in order to make it easier for the operator to install the equipment. The distribution of the components and operation of the system has no variables; in general, it is only the location of the nozzles and the respective conductor rods. Additional changes should be evident for a skilled person in the art.

Following an individual description of each of the principal components of the system referred to and subject of the present invention is provided.

Voltage Detector

The detector is mounted inside the control, breaker and protection device, as the rest of the system, and is therefore immune to weather changes, UV rays and its life expectation is not affected by any of this factors.

This same feature prevents failure points because of the electrical installation itself and reduces material as labor costs. Installation and start up times are lower and no maintenance is required. The voltage detector may be installed from the outlet of the breaker chamber 8 up to the bottom internal part of the nozzle 10, as long as it is concentric with the rods 7. This detector is not shown in the drawings.

Current Detector

The current detector, not shown, is a single unit with the voltage detector and therefore it can also be installed from the outlet of the breaker chamber 8 up to the bottom internal part of the nozzle 10, as long as it is concentrically placed in relation to the rods 7.

Signal Conditioning Unit

This system contains a signal-conditioning unit in direct mode to indicate the presence of voltage in the distribution line, in the insulator 10 and in the breaker, in the range from 100 V up to 1,000,000 V AC or DC. This conditioning unit and the voltage detector are a single unit. Because of its high reliability, and because it is situated inside the tank and therefore protected from the environment, the deterioration of the unit caused by the environment is minimal and thus it is also lower than those units mounted on cross arms or those operating in an open area. Due to its electronic design, it has practically no deterioration either and dispels heat. Another characteristic that contributes to its reliability is the fact that there is no physical connection to the high voltage wiring, because the measurement is used taking advantage of the magnetic field that a current creates around every electrical conductor. In the vast majority of the commercial devices in use, the signal conditioning unit is connected directly to the high voltage line as a voltage divider, being therefore exposed to environmental deterioration, degradation of the insulation used, and atmospheric discharges or partial discharge damage in general, that destroy them. Because of the operation range, the conditioning signal unit may be used in transmission lines, distribution lines, and protection systems as well as in hydraulic plants and substations, atomic, thermo electrical and any combination of the above for electricity generation.

Another important characteristic of the conditioning signal unit is that it has a resistive circuit that enables it to condition the signal with zero reactance and is therefore able to detect voltage, regardless of its frequency.

The signal-conditioning unit has also a protection system for transients, frequency as well as voltage or current; therefore it is practically 100% reliable for signal measurement.

As the system is protected by this conditioning unit, it can be installed in high atmospheric discharge areas, where industrial noise caused by activation and deactivation of devices with impedances range from zero to 100 Megaohms.

The system of the subject invention is insulated from the environment and is of the dry kind; therefore the operation temperature scale ranges from −20° C. up to 60° C. ambient with no operation problems.

Trip Mechanism

The operation of the trip mechanism includes the accumulation of energy in a couple of springs (not shown), provided by a closing solenoid 15. A sliding shiner contains the accumulated energy in two springs and in parallel to the movement of the shiner the close of the vacuum breaker 8 takes place.

The mechanism is installed in line with the vacuum breaker, on an insulation bar with an over-pressure spring, this spring has two purposes: dampering the impact of the breaker when closing, and the other one is to avoid mechanical oscillations (bounces) between the two contacts which could add to the wear by electric arcing. The trip of the mechanism is carried out by a trip solenoid 15 that opens up the sliding shiner liberating the energy accumulated in the two springs, opening up at the same time the vacuum breaker. Tripping and closing of said mechanism directly depend upon the solenoid operation and is carried out based on the control signals from the microprocessor, analog control or of any other kind of control available in the market; including controls which may be developed in the future.

The trip mechanism has external trip and close levers as well as a signaling flag to show the vacuum breaker's situation; located on the lever compartment. All its mechanical parts are manufactured with corrosion resistant materials, for example: aluminum and stainless steel. It is designed to exceed the mechanical cycle's life expectation, established by national and international electrical standards such as ANSI, IEC, etc. The electrical control system of the protection system is done positioning micro breakers (not shown), sensing the state of the levers on the mechanism and hence the state of the vacuum breaker. once the situation of the micro breakers is known, the electronic protection and control unit 23 takes the necessary signals to gather information on the situation of the equipment. The voltage and current detectors provide the measurement signals to this unit 23 for data processing and the corresponding protection program.

Once the above is accomplished, the unit 23 sends the necessary electrical signals to the solenoids to open or close the current flow through the equipment.

Vacuum Breaker Chamber

The present invention also refers to vacuum breaker chambers 8 or just vacuum chambers used in highest power electrical industry and it mainly refers to a method to increase the life expectancy of the contacts in this chambers and to improve the connection and disconnection capacity of the same. It is important to point out that these chambers are an integral part of the protection system, which is the main subject matter of this application.

The vacuum breaker chambers are devices used to prevent or allow the passage of current through a couple of contacts placed inside these chambers.

The cost of these chambers is very high and the cost of the consequences of a standstill caused by them. Hence, it is very important to have this type of device to ensure a long life expectation of the operation.

These vacuum chambers are coupled to magnetic solenoids, which due to its topography, occupy a very large space. To avoid this inconvenience, in the present system, we designed a chamber that because of the disposition of its parts occupies a smaller space than current chambers.

In the state of the art, this configuration, suffers a serious operation problem for working current above 8,000 amperes. The problem is that in high amperes values, the chambers (bottles), before the present application, inevitably wear down.

It is therefore an additional object of the present invention; to provide a method that solves this problem and that at the same time allows that the bottle-solenoid unit occupies minimum space.

The method, through which the above described matter is accomplished, is to place in parallel with the contact leads of the bottle, a magnetic plated element of the inductive type, when parallel to the vacuum chamber.

When the contacts in a vacuum breaker chamber are opened or closed, a magnetic field is generated between the contacts, and this field can have different characteristics, depending mainly on the shape of the contacts, e.g. rotative.

After testing, it was finally found that while closing, an inclination in the contacts occurred and that it inevitably turned into a failure in the bottle.

Figure 4:
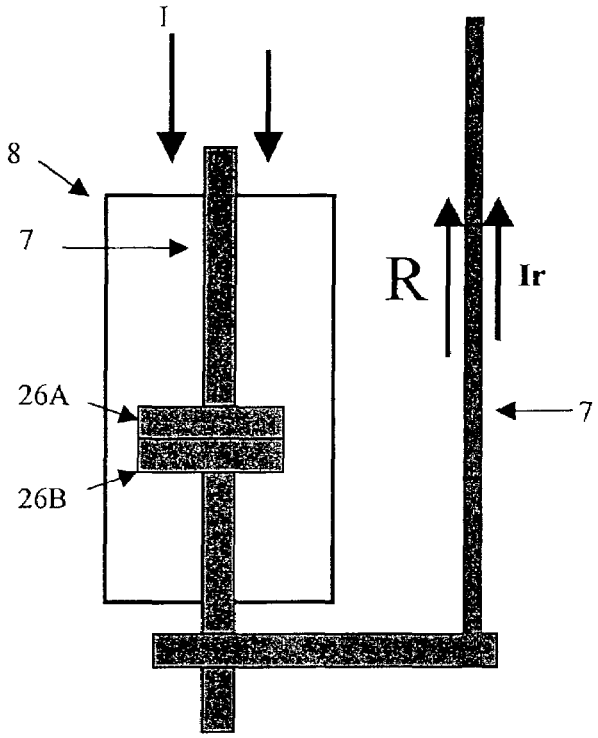
FIG. 4 shows a vacuum bottle with its contacts in a closed position, which can operate up to approximately 8,000 amperes without failure with the distribution of components as shown in FIG. 1A.

As shown in FIG. 4, before exceeding the nominal value of approximately 8,000 amperes, the operation of the bottle 8 is apparently normal, the contacts 26A and 26B open and close without problems, keeping the mechanical and magnetic operation with no interference. The current I circulates through a movable bar 25B, a fixed bar 25A, the contacts 26A and 26B and through the return bar 7.

By achieving that the opening/closing motion of the contacts 26A and 26B in the vacuum chamber 8, make contact in an almost parallel form, one may use all the contact surface in the contacts and thus eliminate the problem created by a contact situated at only one point and therefore avoid overheating and fusion of both such contacts.

Figure 5:
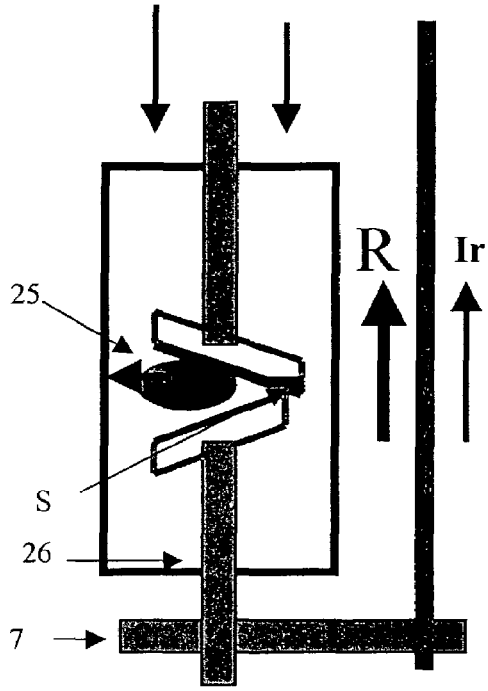
FIG. 5 depicts the same vacuum bottle but with a current value above 8,000 amperes and an effect that is shown on the contacts clearly indicating an inclination of the same and therefore a failure in the bottle.

In FIG. 5, the case of a one contact area between the contacts is shown, the vacuum bottle produces a failure caused by the welding S between the contacts 26A.

FIG. 5 shows what happens when the current, in the topography shown in the bottle, in the lead elements 7, 26A, and 26B exceeds 8,000 amperes.

To solve this problem, the present invention provides a method to avoid the situation that the contacts loose the parallel plane between them, which would favor the failure of the contacts. It is important to point out that this problem occurs primarily when the return current lead is parallel to the vacuum chamber and its location is near the same, as shown in FIG. 1A.

It was surprisingly found that the failure was caused by the lead 7, and more specifically, by the magnetic field R, generated by failure current Ir that circulates through this lead. This magnetic field R "magnetically pushes" the magnetic field 25 that is generated between the contacts 26A and 26B when opening or closing, deforming it and causing the above mentioned inclination.

In a preferred embodiment, the method comprises avoiding the magnetic interference of the lead 7 in the vacuum breaker chamber, by connecting a coil in parallel the magnetic field B thereby created will nullify the one created by the failure current Ir, and eliminating the interaction with the magnetic field 25. The properties of this coil, can be calculated based on the intensity and direction of the current flow I. This coil is also mentioned in this invention as a magnetic shield of the inductive type, which, as previously mentioned may include a magnetic insulation for the rod.

Figure 6:
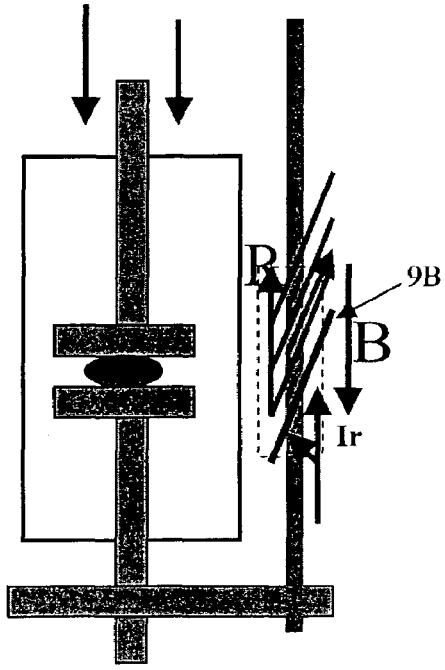
FIG. 6 shows the solution that the present invention provides to avoid the effect shown in FIG. 5.

The rod, schematically shown in FIGS. 1A and 6 as well as 9A, is winded in such a way that when passing a current through it, it will generate a magnetic field opposed to the magnetic field R, generated by the failure current Ir in the return bar 7, thereby producing an overall magnetic field or one in equilibrium that will stop the magnetic field from moving, as shown in FIG. 5.

In another preferred embodiment, the insulation is made by the use of insulation based on varnish and insulating epoxy resins referred herein as dry insulation, as is commonly known in the electrical industry. Such coatings had not been used in systems as the one object of the present invention.

In a more preferred embodiment, the magnetic shield is combined with a magnetic insulation, that is to say, the magnetic shield is placed in the form of a coil 9A, also represented in FIG. 1A as previously described and a dry insulation formed by items 7A, 7B, & 7C.

By using the techniques and concepts of the present invention, the life expectation of the vacuum bottle will only be affected basically by mechanical matters and more.

Specifically, by the wear caused in the movable body inter-phase bar in the vacuum chamber. Therefore, the method described in the present invention increases the operation life expectation of a bottle, without modifying the design or its components.

It is generally assumed that currents near or below 8,000 amperes, even when the magnetic field R apparently does not cause a failure in the bottle, it does contribute to the failure of the same, by applying a constant force over the magnetic field 25, and therefore in the contacts 26A and 26B, and even though the present invention is oriented to be applied in currents above the 8,000 amperes, it can also be used in applications with lesser amperes with a larger life expectation than without the use of the present method.

This method does not require an additional current source because it uses the same current that flows through the conductor 7 that generate the damaging field.

It should be understood that the amperes herein mentioned may either be constant or instantaneous and that even though it is better to use a coil to neutralize the effect that the conductor magnetic field has over the magnetic field 28, a different solution may be used, such as magnetic field insulation shields.

Control Unit

The present system can use a conventional electronic control or preferably a microprocessor and/or analog control, based on a conventional electronic relay.

Since the present system is a protection device, its components, for example, the detectors, the bottle and the trip mechanism provide the necessary elements to perform the distribution of the line opening in a reliable way and protect it from permanent or transitory failure.

The protection operation of the high voltage line is performed by a self supported electronic control unit 23, based on the detection points and on the coordination of the single phase control and protection system of high voltage with dry insulation, with other similar systems installed along the distribution circuit, coordinating the trip of the same to minimize the number of users connected to the distribution circuit who in case of failure could be left without electrical current.

The coordination of protection equipments is made based on normalized curves IEC, ANSI and any particular curve, in which to every current value corresponds a trip time, this is done to coordinate the trips to be made by every one of the protection devices installed along a distribution line. In our case, each one of the control elements used in each of the single-phase control and protection systems of high voltage with dry insulation may be of a single calibration or a multiple calibration, depending upon the specific operation it will perform in the electrical distribution system.

The circuits may be analog and/or digital and process the signals from the detectors to operate according to the curve previously selected or programmed.

The system of the present invention may be mounted on the same container equivalent to the tank 19 used in similar state of the art systems, it does not contain oil, and this reduces the risk of explosions, oil changes or failures due to the aging of the oil.

Since a metallic shell insulates this system, the components are not exposed to the atmospheric changes.

It must be pointed out that no additional external connection is required because the system is connected to the input and outlet wires.

The system is tested in a laboratory when it is completely assembled and therefore the risks caused by in the field connections are fully eliminated, this is not the case of the systems currently in use.

The latching of the contacts in the vacuum breaker chamber is totally mechanic, it does not depend on artificial magnetic elements to hold the position of the contact. It is a simple and lasting mechanism, it does not require continuous maintenance and it reduces corrosion to a maximum level because herein corrosion resistant materials are used. This is why we have a very reliable equipment that reduces the risk of mechanical failure.

The spare parts of the single-phase control and protection system of high voltage with dry insulation as a whole are very easy to find. Besides, the system of the present invention works within such a large gap that it can be used for a variety of applications; this reduces the different kinds and number of similar devices in store.

What is claimed is:

1. A high voltage single-phase control and protection system with insulation comprising the components of:

a tank, a voltage detector, a current detector, a signal-conditioning unit, a trip mechanism, a vacuum breaker chamber wrapped with a dry insulation selected from the group consisting of epoxy resins and insulation varnish, and connected to the trip mechanism through a switchboard and a control unit and a protection unit, wherein the voltage detector, the current detector and the signal conditioning unit are placed around a current feeder rod, and the detectors, the vacuum breaker chamber, the control unit and the protection unit cooperate to protect the line to which the system and the other devices are connected to guard against a permanent or temporary failure by opening the circuit through a trip mechanism.

2. The system of claim 1, wherein the voltage detector is electrically connected to the signal conditioning unit, activate the trip mechanism based on a signal emitted by the signal conditioning unit, to control the passage of current, through the vacuum breaker chamber, and the voltage detector detects, amplifies and converts the electric field into an electronic signal for measurement and is not directly connected to the high voltage line.

3. The system of claim 2, wherein the control unit opens the contacts in the vacuum chamber and said control unit can be changed on line.

4. The system of claim 1, wherein the voltage detector detects the voltage through the influence of the magnetic field in conductors, insulators and breakers, said voltage detector positioned from the outlet of the breaker chamber up to the bottom part of a nozzle, and concentrically placed in relation to the switchboard.

5. The system of claim 1, wherein the current detector and the voltage detector are integrated into a single device.

6. The system of claim 1, wherein the signal conditioning unit is integral with the voltage detector and with the current detector, and the conditioning unit amplifies a detected signal; said system comprising said conditioning unit having a resistive circuit for conditioning the signal with zero reactance and then detecting the voltage regardless of the frequency; the conditioning unit having a protection system for frequency, current and voltage transients.

7. The system of claim 1, wherein the protection range of the system is from 5 to 2400 A and from 2400 to 34.5 kV, the control and the protection unit is a single element, and every control element may be calibrated as needed according to the specific function of the control element in the system.

8. The system of claim 7, wherein the vacuum breaker chamber may be replaced as an insulated element.

9. The system of claim 1, wherein the system has posts and associated nuts to maintain the vacuum breaker chamber in position, insulating separators being placed on both sides of the posts for support of the posts, a base for connecting top and bottom connecting terminals, said connecting terminals being connected to a first end of two conductor rods coated with magnetic shielding, a nozzle connected to a second end of the two conductor rods, external connectors being fixed to connect an input and an outlet current line, the switchboard being placed on a lower part of the vacuum breaker chamber, said switchboard being connected to the bottom connector terminal, the bottom connector terminal being placed between the vacuum chamber and the switchboard, the switchboard being fixed to the lower support plate.

10. The system of claim 9, wherein the lower part of the switchboard is threaded and secured to the base of a solenoid, a lower end of the support posts being threaded for securing the trip/close mechanism, each of the support posts having an insulation material divider, a PVC support cylinder being placed about the inside wall of the tank, to provide additional support to a section of the vacuum breaker and an insulation barrier between the metallic tank and the rest of the components connected to high voltage.

11. The system of claim 10, wherein a power source transformer is secured on a bottom insulation plate so as to connect the connecting terminal and the power transformer and, the switchboard transmits the trip/close movement from the trip/close mechanism to a contact in the vacuum breaker chamber.

12. The system of claim 11, wherein the control and protection unit contains all the electronic circuits needed for the processing of the control system, a power transformer being secured on the insulation plate and connected to a phase of the input line to provide current in 120 V for a close solenoid, with the charge system being in line with the system.

13. The system of claim 12, wherein the latching of the trip mechanism is totally mechanical.

14. The system of claim 13, wherein the operation of the trip mechanism comprises the accumulation of energy in at least two springs, a sliding shiner containing the energy accumulated into at least two springs and the vacuum chamber closing taking place at the same time as the movement of the shiner; the trip mechanism being installed in line with the vacuum breaker chamber, over an insulation bar with an over pressure spring, the spring damping the impact to the contact at the close time and avoiding mechanical oscillations between the two contacts, whereby the trip mechanism is tripped by means of an actuator or trip solenoid that opens the sliding shiner and liberates the stored energy accumulated in the two springs, and opening in parallel the vacuum breaker; the trip mechanism directly depending upon the solenoid and performing the operation based on control signals provided by the control unit.

15. The system of claim 10, wherein the shield comprises an insulated coating, a non magnetic metallic pipe and a thermocontractile insulation, the insulated coating comprises impregnated insulation on an insulation material pipe, having a lever compartment located on a higher part of the tank for manual operation of the system, the trip counter and the signaling flag of the vacuum chamber.

16. The system of claim 15, wherein the current travels in and out the nozzle and is substantially parallel to horizontal.

17. The system of claim 15 wherein the nozzle is located substantially perpendicular to the horizontal.

18. The system of claim 17, wherein the conditioning signal unit has a frequency, current and voltage transient protection system.

19. The system of claim 1, wherein said components are mechanically insulated from the environment by a tank.

20. The system of claim 19, wherein the control unit and the protection unit receives signals to gather the information of the equipment's status, the current and voltage detectors provide measurement signals to the control unit and the protection unit for the processing of the data and the control and the protection unit send the necessary electrical signals to a solenoid, to open or close current flow.

21. A high voltage single-phase control and protection system with insulation comprising the components of:

a tank, a voltage detector, a current detector, a signal-conditioning unit, a trip mechanism, a vacuum breaker chamber, connected to the trip mechanism through a switchboard and a control unit and a protection unit, posts and associated nuts for maintaining the vacuum breaker chamber in position, insulating separators being placed on both sides of the posts for support of the posts, a base for connecting top and bottom connecting terminals, said connecting terminals being connected to a first end of two conductor rods coated with magnetic shielding, a nozzle connected to a second end of the two conductor rods, external connectors connecting an input and an outlet current line, the switchboard on a lower part of the vacuum breaker chamber, said switchboard being connected to the bottom connector terminal, the bottom connector terminal being between the vacuum chamber and the switchboard, the switchboard being fixed to the lower support plate, wherein the voltage detector, the current detector and the signal conditioning unit are placed around a current feeder rod, and the detectors, the vacuum breaker chamber, the control unit and the protection unit cooperate to protect the line to which the system and the other devices are connected thereby guarding against a failure.

* * * * *